United States Patent [19]

Leo, Sr.

[11] Patent Number: 4,815,612

[45] Date of Patent: Mar. 28, 1989

[54] DISPLAY FOR PACKAGED SUPPLIES

[75] Inventor: Daniel W. Leo, Sr., New York, N.Y.

[73] Assignee: Ledan, Inc., New York, N.Y.

[21] Appl. No.: 190,634

[22] Filed: May 5, 1988

[51] Int. Cl.[4] ..... A47F 7/00

[52] U.S. Cl. ..... 211/189; 211/59.1; 40/606

[58] Field of Search ..... 248/124, 125, 220.3, 248/220.4, 221.1, 221.2; 211/189, 205, 196, 57.1, 59.1; 40/606, 607, 620, 622, 657, 663

[56] References Cited

U.S. PATENT DOCUMENTS

| | | | |
|---|---|---|---|
| 1,801,058 | 4/1931 | Sutcliffe | 248/221.2 |
| 1,801,453 | 4/1931 | Patterson | 248/220.3 |
| 2,507,875 | 5/1950 | Williams | 40/607 |
| 2,625,762 | 1/1953 | McColl | 40/607 |
| 2,759,281 | 8/1956 | Akers | 40/607 |
| 2,868,386 | 1/1959 | Seyforth | 248/220.4 |
| 2,923,417 | 2/1960 | Sonksen | 248/220.3 |
| 2,940,198 | 6/1960 | Ressel | 40/607 |
| 3,058,246 | 10/1962 | Schoeffler | 40/607 |
| 3,310,899 | 3/1967 | Hart | 40/607 |
| 4,322,905 | 4/1982 | Kruse | 40/606 |

FOREIGN PATENT DOCUMENTS

| | | | |
|---|---|---|---|
| 7801793 | 8/1979 | Netherlands | 40/607 |
| 622463 | 9/1978 | U.S.S.R. | 40/606 |

*Primary Examiner*—J. Franklin Foss
*Assistant Examiner*—Robert A. Olson
*Attorney, Agent, or Firm*—Charles E. Temko

[57] ABSTRACT

An improved display device suitable for supporting packaged expendable items, normally for use with a single article of manufacture, such as supplies for a typewriter and the like. The device may be used by supporting it on a horizontal surface, such as a counter, or separated into components for support upon a vertical surface such as a wall. The device includes a plurality of molded rectangular panels having openings for supporting peg board hooks. The panels are interconnected in opposed pairs to form a two-sided display supported in rotatable manner upon a base. An auxiliary upper panel which may carry advertising material is integrally molded therewith. The panels are maintained together by slideably engaged edge members at the sides thereof, and at the bottom thereof by semi-circular projections which are maintained in abutted relation by a retaining ring. A supporting pull penetrates the ring and projections to interconnect the panels with a horizontally oriented base.

2 Claims, 2 Drawing Sheets

DISPLAY FOR PACKAGED SUPPLIES

BACKGROUND OF THE INVENTION

This invention relates generally to the field of display devices suitable for presenting small articles for selective retail sale, and more particularly to an improved form thereof suitable for supporting such articles in packaged form in horizontally stacked relation upon elongated hooks for serial removal.

It is commonplace in present day retail distribution to package individual items in a paper or synthetic resinous envelope having a through opening adjacent an upper edge thereof to permit a plurality of envelopes to be arranged in horizontal stacked relation to allow removal of the outermost envelope by a customer. The most common type of device for accomplishing this end is a simple peg board usually mounted upon a wall or other vertical surface. Such devices do not normally lend themselves to support from a horizontally oriented surface such as a retail display case or counter. While display devices which are supported from such counters are also known in the art, such constructions are relatively expensive and usually designed to display particular types of merchandise in the absence of packaging.

SUMMARY OF THE INVENTION

Briefly stated, the invention contemplates the provision of an improved display device of the class described which may be conveniently fabricated from molded synthetic resinous materials with convenience in assembly to one of a variety of configurations. The disclosed embodiment includes a pair of display panel elements which are abuttable in back-to-back relation to be maintained by a pair of slideably engageable end members. An upper display panel suitable for carrying advertising indicia is formed integrally with the merchandise supporting portion. The lower edge portions of each of the display panel elements are provided with mating semi-circular projections, which are in abutted relation, and clamped together by an angular retailing ring which provides means for engaging a supporting base. The panels are also provided with keyhole openings for separate mounting upon a wall, where desired.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
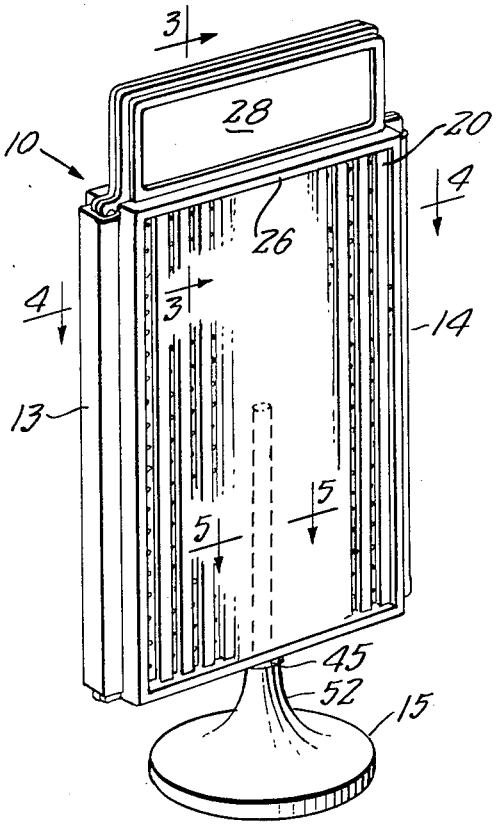
FIG. 1 is a perspective view of the invention assembled in free-standing mode.
Figure 2:
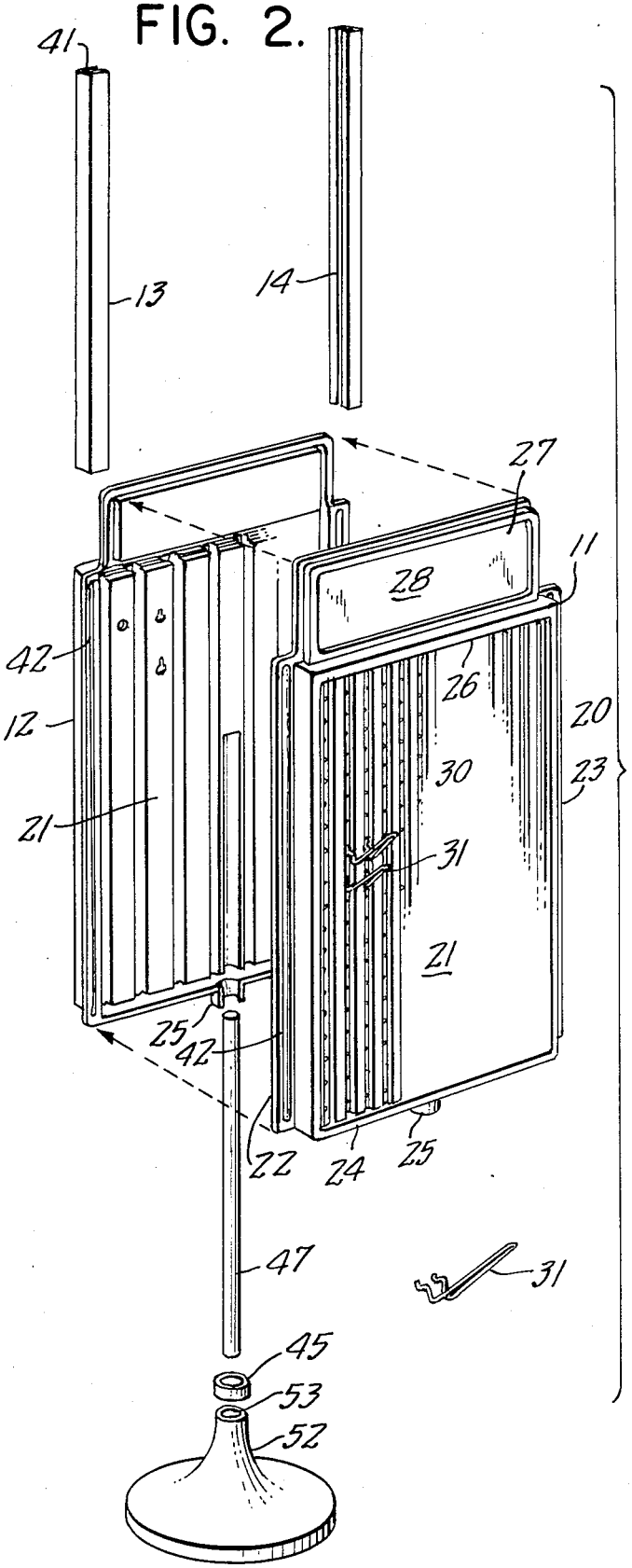
FIG. 2 is an exploded perspective view of an embodiment of the invention.
Figure 3:
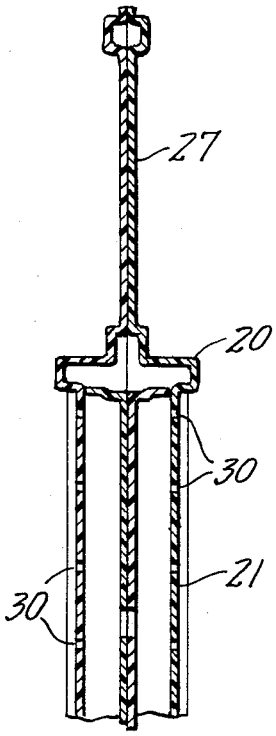
FIG. 3 is an enlarged cross-sectional view taken on the line 3—3 in FIG. 1.
Figure 4:
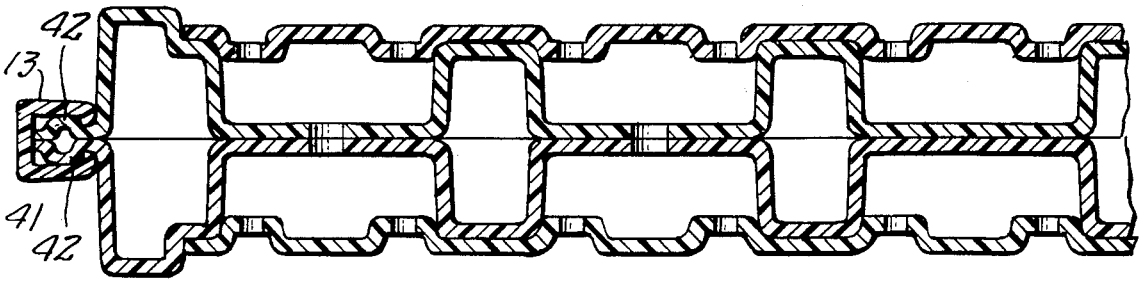
FIG. 4 is an enlarged cross-sectional view taken on the line 4—4 in FIG. 1.
Figure 5:
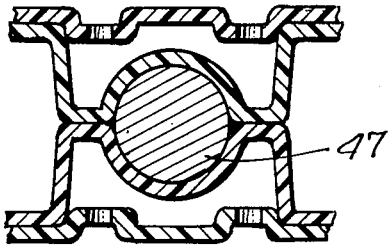
FIG. 5 is a fragmentary cross-sectional view on the line 5—5 as seen FIG. 1.
Figure 6:
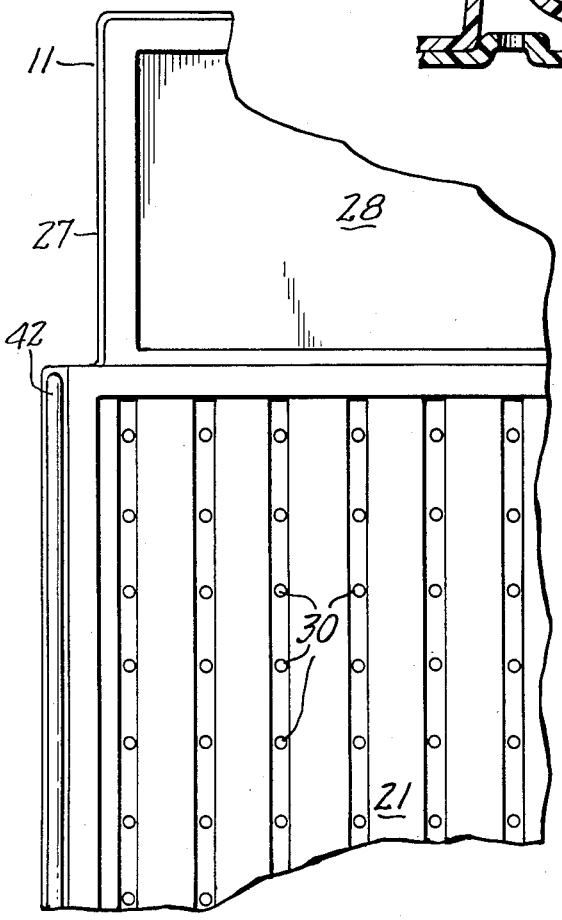
FIG. 6 is a fragmentary elevational view of an individual display panel element.
Figure 7:
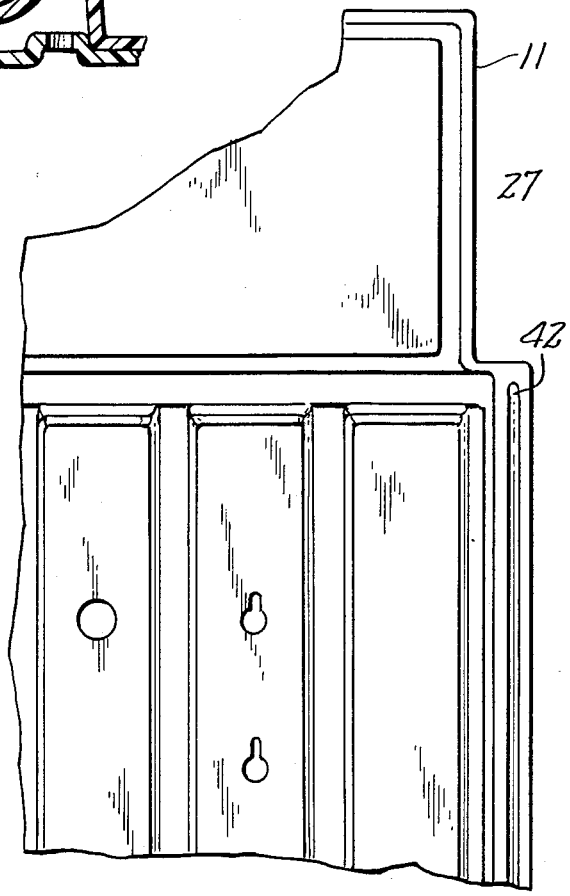
FIG. 7 is a fragmentary elevational view showing the surface opposite that seen in FIG. 6.

In accordance with the invention, the device, generally indicated by reference character 10, comprises broadly: first and second display panel elements 11 and 12, first and second edge members 13 and 14, and a circular base member 15.

The panel elements 11 and 12 are substantially identical, each including a main body 20 having a centrally disposed display area 21, and bordered by side edge portions 22 and 23, a lower edge portion 24, a semi-circular projection 25. An upper edge portion 26 is molded integrally with an upper display panel 27 having a surface 28 displaying an informational legend on a front surface 29 thereof.

To provide for the mounting of packaged articles, the area 21 is provided with plural openings 30 for supporting elongated peg board hooks 31. The usual type of display element 32 is provided with an opening engageable with said hooks.

The edge members 13 and 14 are also identical, and are preferably formed as extrusions from flexible synthetic resinous material. Each includes a generally U-shaped cross section forming a groove or channel 41 which engages a corresponding bead 42 on each of the side edge portions 22 and 23 of the display elements. The lower edge portions 24 when abutted, also place the projections 25 in abutted relation to form a completely circular shape. Engaging the abutted projections is an annular retaining ring 45 which also forms a socket for engaging a vertical pole 47. The pole, in turn, being supported by the base member 15.

The base member 15 is also preferably formed as a synthetic resinous molding, and includes a lower surface 51 for engaging a display counter (not shown) or other horizontal surface. A conical portion 52 tapers upwardly and forms a socket 53 in which the pole 47 is disposed.

Normally, the device may be shipped in unassembled condition, requiring only the abutting of the display panel elements, the sliding engagement of the edge members 13 and 14, the engagement of the member 45, and the assembly of the base member 15 with the pole 47 which is then projected into the member 45.

Where wall mounting is desired, the panel elements 11 and 12 may be left in unassembled condition, and engaged upon nails or screws which penetrate keyhole openings 57 for that purpose.

It will be observed that substantially the entire device may be formed from blow moldings, or extrusions, thus permitting very low cost of manufacture, with consequent wide sale, distribution and use.

I wish it to be understood that I do not consider the invention to be limited to the precise details of structure shown and set forth in this specification, for obvious modifications will occur to those skilled in the art to which the invention pertains.

I claim:

1. An improved display device for supporting packaged articles from hooks in horizontally stacked relation comprising: first and second planar rectangular display panel elements, each having a centrally disposed display area and first and second oppositely disposed vertical side edges having an enlarged bead thereon, said panel elements having a lower horizontal edge having a generally semi-circular projection thereon, said display panel elements being positioned in back-to-back congruent relation; a pair of elongated edge members forming an axially extending channel, each member engaging a vertical edge of said abutted display elements to maintain them in abutted relation; and a retaining ring engaging said semi-circular projections to maintain said lower edges in abutted relation.

2. An improved display device in accordance with claim 1, further comprising a vertically oriented post engaging said retaining ring, and a base having a horizontal lower surface supporting said post.

* * * * *